United States Patent [19]

Hemsath et al.

[11] Patent Number: 5,018,707

[45] Date of Patent: May 28, 1991

[54] HEATING FURNACE

[75] Inventors: Klaus H. Hemsath, Toledo, Ohio; H. Kenneth Staffin, Colonia; Michael Owsiany, Edison, both of N.J.

[73] Assignee: Gas Research Institute, Chicago, Ill.

[21] Appl. No.: 323,290

[22] Filed: Mar. 14, 1989

[51] Int. Cl.[5] ..... F27B 5/08

[52] U.S. Cl. ..... 266/254; 266/251; 432/212; 432/213

[58] Field of Search ..... 266/251, 252, 254, 255, 266/256; 432/212, 213

[56] References Cited

U.S. PATENT DOCUMENTS

| | | | |
|---|---|---|---|
| 755,867 | 3/1904 | Gesner | 266/255 |
| 1,111,871 | 9/1914 | Stevens | 432/213 |
| 1,193,069 | 8/1916 | Roberts | 432/213 |
| 1,354,210 | 9/1920 | Porbeck | 432/212 |
| 1,356,788 | 10/1920 | Roberts | 432/213 |
| 2,174,052 | 9/1939 | Woodson | 432/213 |
| 3,397,875 | 8/1968 | Davis, II | 266/254 |
| 3,690,636 | 9/1972 | Shannon et al. | 266/254 |
| 4,154,433 | 5/1979 | Kato | 266/255 |

*Primary Examiner*—S. Kastler

*Attorney, Agent, or Firm*—Kane, Dalsimer, Sullivan, Kurucz, Levy, Eisele and Richard

[57] ABSTRACT

A heating mantle for heating materials, such as metals, alloys or inorganic chemicals in a retort, includes a tubular wall and annular chambers cooperating with said wall for forming a tortious path around the retort for hot gases. The mantle provides a very high convective heat transfer coefficient.

10 Claims, 2 Drawing Sheets

HEATING FURNACE

BACKGROUND OF THE INVENTION

1. Field of Invention

The invention pertains to a gas-fired heating mantle for heating a retort furnace. This heating mantle provides an improved path for the combustion gases, thereby raising the rate of heat transfer to the furnace.

2. Description of the Prior Art

Gas-fired heating mantles are extensively used in the metal processing industry for treating and processing metals and alloys, as well as in the inorganic chemical industry in reactors. However, present mantles are severely deficient in a number of areas which limits their use in commercial applications. The primary deficiency of present heating mantles is the limited heat transfer rate from the mantle to the retort.

Typically, a gas-fired heat mantle surrounds a furnace retort vessel, and is constructed to provide a high rate of heating in a small space. Typically, the mantle is made of a steel shell with an inside lining of insulating refractory and must be shaped to direct combustion flames away from the retort vessel to avoid damaging it. In this configuration, heat is transferred to the retort primarily through two mechanisms: one, by convective heat transfer from the combustion gases to the interior mantle wall and the retort vessel wall; and two, by radiation from the interior mantle wall to the retort vessel wall. In a gas-fired heating mantle, at temperatures below 1200° F., the radiation heat transfer rates are low due to lower temperatures, and the convective heat transfer rates are generally low due to low gas velocities. This combination results in low overall heat transfer rates.

At temperatures above 1400° F., heat transfer by radiation from the mantle wall occurs at high rates, however, the convective rates to the heating mantle wall remain low and becomes the rate limiting step in the overall heat transfer process. This keeps the overall heat transfer rates low. Typically, present heating mantles have a heat transfer rate in the range of 5–15 BTU/sq. ft.-hr.-degree F. depending upon temperature level and gas flow rates.

OBJECTIVES AND SUMMARY OF THE INVENTION

In view of the above disadvantages of the prior art, it is an objective of the present invention to provide a heating mantle with an improved overall heat rate transfer, in the range of 15–50 BTU/sq. ft.-hr.-degree F., depending upon temperature level and gas flow rates.

The objective is accomplished by providing a heating mantle with an innovative geometric configuration for improved heat transfer by convection which is the mechanism causing low heat transfer rates in gas-fired heating mantles.

Other objectives and advantages of this invention shall become apparent from the following description of the invention. Briefly, a heating mantle constructed in accordance with this invention, makes use of a baffle arrangement termed "slot-jet configuration." In this configuration, the overall heat transfer coefficient of the gas-fired heating mantle is increased by increasing the convective coefficient of heat transfer between the combustion gases and the heating mantle as well as the retort vessel walls. In addition, the mantle wall area for convective heat transfer, and the overall heating area available for the heat transfer are increased. This is accomplished by a plurality of axially spaced annular chambers surrounding the retort. The chambers are formed by suitably shaped baffles and are interconnected by slots for providing a tortious path for the combustion gases. A substantial pressure drop (approximately one inch water column) is obtained between each chamber and the adjacent one, resulting in a series of offset gas jets between the chambers yielding a high velocity impingement on the walls of the adjacent chamber above. This produces turbulence and results in a high rate of convective heat transfer. This configuration results in a heat transfer rate in the range 15–50 BTU/sq. ft.-hr.-degree F., depending on the gas-fired heating mantle operating conditions.

DETAILED DESCRIPTION OF THE INVENTION

Figure 1:
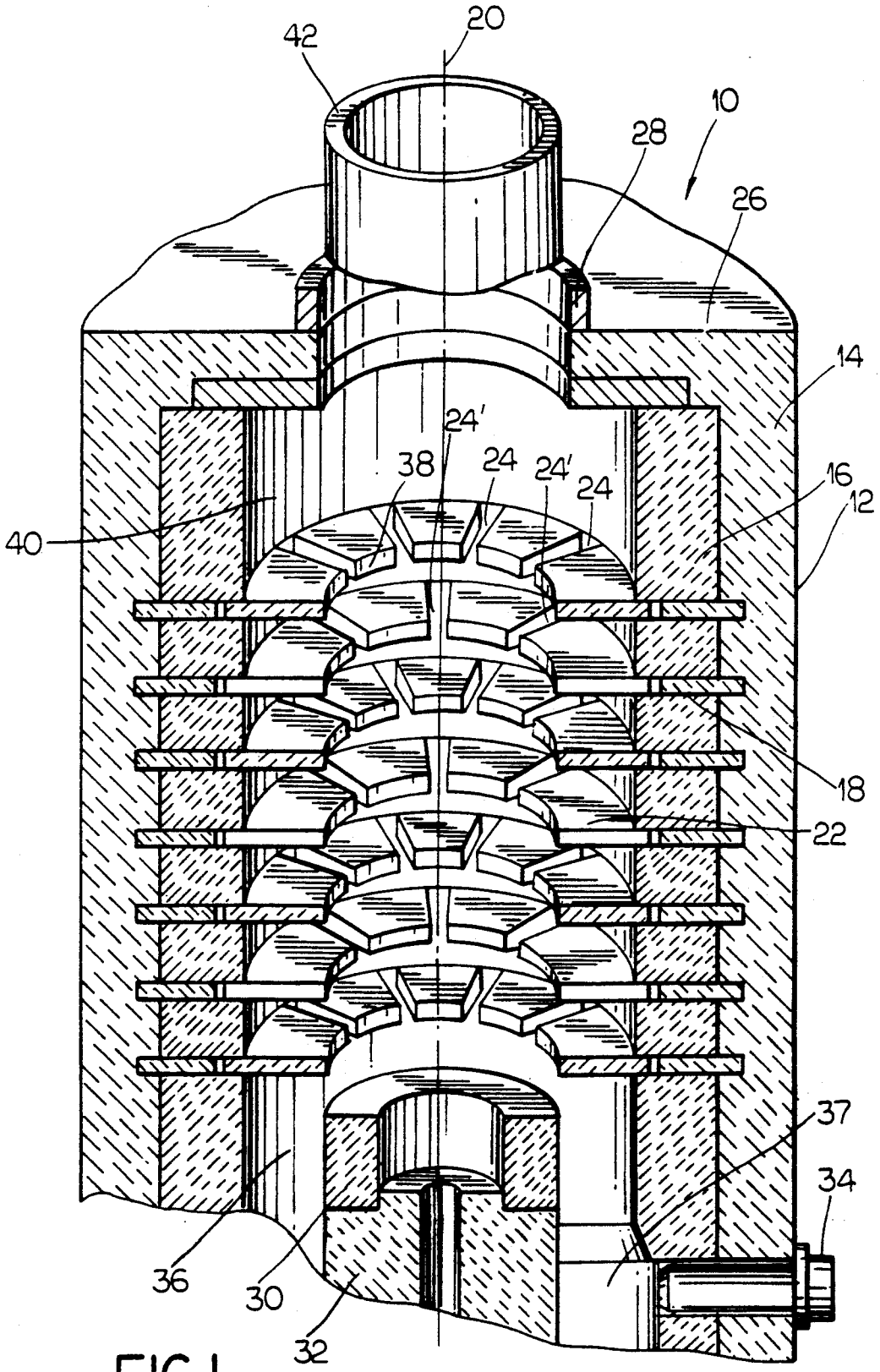
FIG. 1 shows a partial sectional isometric view of a heating mantle constructed in accordance with this invention.

Referring now to the drawings a heating furnace 10, constructed in accordance with this invention comprises a jacket 12, filled with a low density, high insulating valve castable material 14. Imbedded in the material is a substantially vertical, dense, low porosity cylindrical wall 16 shape made from a cement castable. The wall 16 supports a plurality of baffles 18, made of cast and pre-fired ceramic annular segments axially spaced around the axis 20, of wall 16. Thus, these baffles 18, define a plurality of annular chambers 22. The chambers are interconnected by a plurality of slots 24, 24'.

Importantly, the slots of adjacent baffles 18, are not aligned with each other but are offset angularly around the cylindrical wall. Thus, in FIG. 1 slots 24, are angularly offset from the slots 24' of the adjacent baffle.

The cylindrical wall 16 is covered with a top 26 having a circular opening 28. The opening 28 extends through the top 26 to the internal chamber formed by the cylindrical wall 16. Also within wall 16, there is a cylindrical pedestal 30 with a concentric tube 32 extending downwardly. The pedestal 30 and wall 16 define a combustion gas channel 36 for directing combustion gases into the first annular chamber 22. This channel also protects the retort vessel 42 from direct flame impingement. A combustion chamber 37 for collecting combustion gases from a burner 34 is formed by the concentric tube 32 and the wall 16. Each of the baffles 18, have an inner circular surface 38 to define a tubular space. The top 26, wall 16, and the upper most baffle form an output annular chamber 40, for collecting the gases from the annular chambers 22 and prior to exhausting them through the exhaust duct 52.

Figure 2:
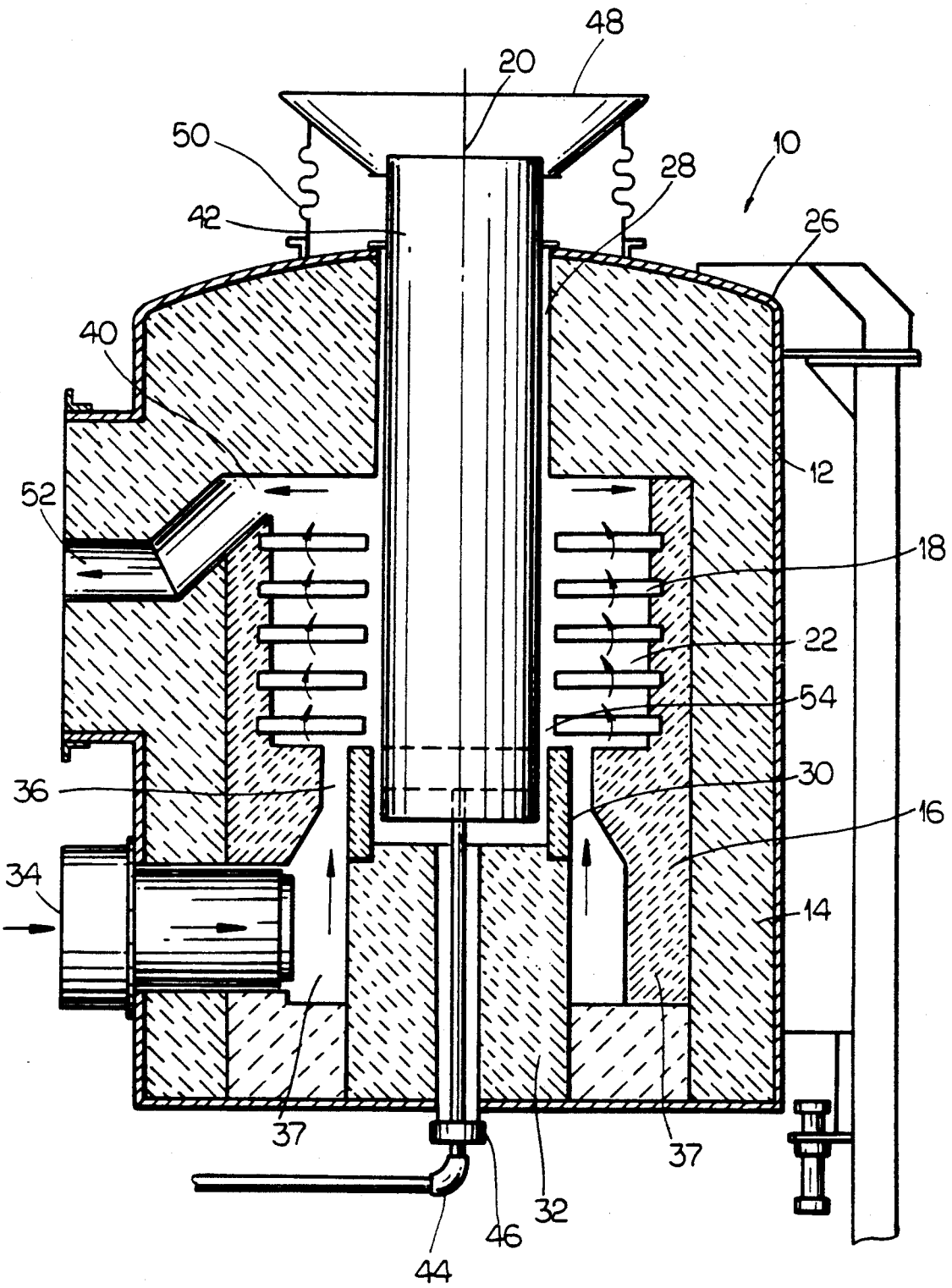
FIG. 2 shows a somewhat diagrammatic view of the complete mantle of FIG. 1 with a retort vessel.

The elements of the mantle are shaped and arranged so that a cylindrical vessel can be lowered through the opening 28 while being supported on the top 26 and extending down through the pedestal 30 remaining unobstructed by the concentric tube 32. Such a cylindrical vessel 42, is shown in position in FIG. 2. The vessel has a feed pipe 44, extending through the tube 32. A seal 46, between tube 32 and feed pipe 44 prevents the hot combustion gases from escaping. The vessel 42 extends through the opening 28 in the top 26 and terminates with an open top 48 for adding or removing material from the vessel. A gas seal 50 is used to prevent escape of the combustion gases through the opening 28.

The heating mantle described above operates as follows: Combustion gases are fired from the one or more burners (34) into the combustion chamber 37. From the combustion chamber 37, the gases are injected serially into the chambers 22, formed by the baffles 18. The gases travel from one chamber to another through slots 24, and through the space 54, formed between the inner surfaces 38, of the baffles 18, and the vessel 42. Due to this tortuous path between the chambers, the gases form jets which impinge on the baffles 18 which (especially as they exit from slots 24, 24') form turbulence within chambers 22. Thus, heat is transferred connectively from the gases directly to the vessel 42, as well as to the baffles 18, and the cylindrical wall 16. The heat absorbed by the wall 16 and baffles 18, is also transferred to the retort through radiation.

After passing through the annular chambers 22, the combustion gases are collected in the output chamber 40, and exhausted through an outlet 52.

Housing 12, is made preferably of steel. The insulation 14 and side wall are preferably made of insulating castable.

Obviously, numerous modifications may be made to the present invention without departing from their scope as defined in the appended claims.

What is claimed is:

1. A heating mantle for heating a retort having an elongated tubular body comprising:

a source of hot gases;

cylindrical wall means; and a plurality of baffles supported by and extending radially inwardly from said cylindrical wall means to form a space for said retort, said baffles and said cylindrical wall means cooperating to form a plurality of heating chambers in communication with said source and open to said space, said chambers defining a tortuous path for said gases for transferring heat to said retort; said cylindrical wall means being disposed substantially vertically, and said baffles extending in planes perpendicular to said cylindrical wall means, said heating chambers being interconnected by slots in said baffles, said slots being radially offset from one baffle to another.

2. The heating mantle of claim 1 further comprising an input chamber connected to said heating chambers, and a burner for firing said hot gases into said input chamber.

3. A heating apparatus comprising:

a housing made of an insulating material and having a top;

a cylindrical wall imbedded in said insulating material and having a longitudinal axis;

a plurality of ceramic baffles supported from said cylindrical wall and extending radially inward to form a tubular space, said baffles cooperating to define annular heating chambers open to said space;

a retort for holding materials for heating said retort being supported by said top and extending into said tubular space without touching said baffles; and a source of hot gases; said baffles, said cylindrical wall and said retort cooperating to form a tortuous path for hot gases for convective heat transfer to said retort.

4. The heating apparatus of claim 3 wherein each baffle is formed with a radial slot for providing communication between adjacent heating chambers.

5. The heating apparatus of claim 4 wherein the slot of one baffle is angularly offset from the slot of an adjacent baffle.

6. The heating apparatus of claim 3 further comprising an input chamber connected to said heating chambers and a burner for firing said hot gases into said input chamber.

7. The heating apparatus of claim 3 further comprising a pedestal for protecting said retort.

8. The heating apparatus of claim 7 wherein said retort includes an output pipe for adding and removing material from said retort.

9. The heating apparatus of claim 8 wherein said output pipe extends at least partially through said pedestal.

10. The heating apparatus of claim 3 wherein said retort includes an input opening for removing and receiving materials for heating.

* * * * *